US009694945B2

(12) United States Patent
Ciecorka et al.

(10) Patent No.: US 9,694,945 B2
(45) Date of Patent: Jul. 4, 2017

(54) FITMENT COUPLER WITH CAP

(71) Applicant: CSM Bakery Products NA, Inc., Tucker, GA (US)

(72) Inventors: Thomas Ciecorka, Suwanee, GA (US); Sarah Key, Buford, GA (US)

(73) Assignee: CSM BAKERY PRODUCTS NA, INC., Tucker, GA (US)

( * ) Notice: Subject to any disclaimer, the term of this patent is extended or adjusted under 35 U.S.C. 154(b) by 210 days.

(21) Appl. No.: 14/542,109

(22) Filed: Nov. 14, 2014

(65) Prior Publication Data

US 2015/0129610 A1 May 14, 2015

Related U.S. Application Data

(60) Provisional application No. 61/904,364, filed on Nov. 14, 2013.

(51) Int. Cl.

| | |
|---|---|
| ***B65D 35/38*** | (2006.01) |
| ***B65D 35/44*** | (2006.01) |
| ***B65D 35/02*** | (2006.01) |
| ***B65D 75/58*** | (2006.01) |

(52) U.S. Cl.

CPC ..... *B65D 35/38* (2013.01); *B65D 75/5883* (2013.01)

(58) Field of Classification Search

CPC ..... B65D 35/38; B65D 35/44; B65D 35/02; B65D 75/5883; B65D 75/58; B65D 75/5855; B65D 75/5861; B65D 75/5872; B65D 75/5877; B65D 35/36; B65D 35/10

USPC ..... 222/92, 107, 566–568

See application file for complete search history.

(56) References Cited

U.S. PATENT DOCUMENTS

| | | | |
|---|---|---|---|
| 786,779 | A | 4/1905 | Sykes |
| 883,657 | A | 3/1908 | Lutge |
| 2,176,923 | A | 10/1939 | Nitardy |
| 2,320,496 | A | 6/1943 | Wechsler |
| 3,736,933 | A | 6/1973 | Szabo |
| 3,847,523 | A | 11/1974 | Parrish et al. |

(Continued)

FOREIGN PATENT DOCUMENTS

| | | |
|---|---|---|
| EP | 0 757 006 | 2/1997 |
| EP | 0 897 672 | 10/2002 |

(Continued)

OTHER PUBLICATIONS

International Search Report and Written Opinion mailed Mar. 12, 2015 in corresponding PCT/US2014/065800 filed Nov. 14, 2014.

(Continued)

*Primary Examiner* — J. Casimer Jacyna

(74) *Attorney, Agent, or Firm* — Gilberto M. Villacorta; Sunit Talapatra; Foley & Lardner LLP

(57) ABSTRACT

A fitment assembly is operable to dispense confectionary from a container and to operably support a decorating nozzle through which the dispensed confectionary is discharged. The fitment assembly includes a fitment body and a coupler. The coupler includes a coupler ring presenting a ring opening, with the fitment body extending into the ring opening. The coupler further includes a coupler cap covering the fitment opening and removably attached to the coupler ring along a line of weakness. The coupler cap is separable from the coupler ring along the line of weakness to expose the fitment opening.

26 Claims, 5 Drawing Sheets

(56) References Cited

U.S. PATENT DOCUMENTS

| | | | |
|---|---|---|---|
| 3,964,643 | A | 6/1976 | Morane et al. |
| 4,872,556 | A | 10/1989 | Farmer |
| 4,917,267 | A | 4/1990 | Laverdure |
| 4,961,517 | A | 10/1990 | Tkac |
| 5,052,588 | A | 10/1991 | Schlosser |
| 5,114,004 | A | 5/1992 | Isono et al. |
| 5,213,860 | A | 5/1993 | Laing |
| 5,352,043 | A | 10/1994 | Takagaki et al. |
| 5,353,961 | A | 10/1994 | Debush |
| 5,816,450 | A | 10/1998 | Alexander et al. |
| 5,954,230 | A | 9/1999 | Blette et al. |
| 6,153,238 | A | 11/2000 | Shannon |
| 6,164,822 | A | 12/2000 | Beer |
| D436,030 | S | 1/2001 | Tedeschi, Jr. et al. |
| 6,179,165 | B1 | 1/2001 | Knight et al. |
| D453,295 | S | 2/2002 | Bell et al. |
| D454,487 | S | 3/2002 | Bell et al. |
| D455,645 | S | 4/2002 | Bell et al. |
| 6,578,740 | B1 | 6/2003 | Hagihara |
| 6,942,643 | B2 | 9/2005 | Eakins et al. |
| 6,945,394 | B2 | 9/2005 | Segovia, Jr. et al. |
| 6,981,614 | B2 | 1/2006 | Niggemyer |
| 7,004,354 | B2 | 2/2006 | Harper |
| 7,021,505 | B2 | 4/2006 | Franczyk |
| D519,848 | S | 5/2006 | Kirou et al. |
| 7,232,042 | B2 | 6/2007 | Last |
| D558,594 | S | 1/2008 | Kirou et al. |
| 7,337,923 | B2 | 3/2008 | Niggemyer et al. |
| D581,808 | S | 12/2008 | Schwartz |
| D583,255 | S | 12/2008 | Castor |
| 7,478,736 | B2 | 1/2009 | Morgan |
| 7,506,754 | B2 | 3/2009 | Segovia, Jr. et al. |
| 7,581,899 | B2 | 9/2009 | May et al. |
| 7,618,405 | B2 | 11/2009 | Young |
| 7,762,439 | B2 | 7/2010 | Niggemyer et al. |
| 7,828,176 | B2 | 11/2010 | Harper |
| 8,336,758 | B2 | 12/2012 | Scheu |
| 8,376,183 | B1 | 2/2013 | Rosen |
| 2003/0044482 | A1 | 3/2003 | Stachowicz et al. |
| 2004/0112915 | A1 | 6/2004 | Franczyk |
| 2004/0124210 | A1 | 7/2004 | Bartlein |
| 2005/0072442 | A1 | 4/2005 | Licari et al. |
| 2005/0170051 | A1 | 8/2005 | Folkmar |
| 2006/0006194 | A1* | 1/2006 | Niggemyer ..... B65D 1/0246 222/107 |
| 2007/0110344 | A1 | 5/2007 | Murray |
| 2007/0119862 | A1 | 5/2007 | Backes et al. |
| 2007/0217717 | A1 | 9/2007 | Murray |
| 2007/0278114 | A1 | 12/2007 | Kane et al. |
| 2008/0029556 | A1 | 2/2008 | Chen |
| 2008/0089967 | A1 | 4/2008 | Bourque |
| 2009/0028470 | A1 | 1/2009 | Murray |
| 2009/0095369 | A1 | 4/2009 | Murray |
| 2011/0068119 | A1 | 3/2011 | Wurster, Jr. |
| 2011/0303670 | A1* | 12/2011 | Baker ..... A61J 1/1475 220/257.1 |
| 2012/0006849 | A1 | 1/2012 | Folkmar |
| 2013/0306674 | A1 | 11/2013 | Read |
| 2015/0129608 | A1 | 5/2015 | Ciecorka et al. |
| 2015/0129609 | A1 | 5/2015 | Ciecorka et al. |
| 2015/0274391 | A1* | 10/2015 | Tsuruta ..... B65D 75/5883 383/59 |

FOREIGN PATENT DOCUMENTS

| | | |
|---|---|---|
| EP | 0 830 818 | 12/2002 |
| FR | 1 482 327 | 5/1967 |
| FR | 2 892 100 | 4/2007 |
| JP | 4326503 | 9/2009 |
| WO | 2007/045747 | 4/2007 |

OTHER PUBLICATIONS

Office action dated Nov. 4, 2015 in co-pending U.S. Appl. No. 14/541,938, filed Nov. 14, 2014.

JP4326503 (JP2006-325560) Machine Translation in English, 9 pages.

Office Action dated Mar. 10, 2016 in co-pending U.S. Appl. No. 14/542,028, filed Nov. 14, 2014.

* cited by examiner

FITMENT COUPLER WITH CAP

RELATED APPLICATION

This application claims the benefit of U.S. Provisional Application Ser. No. 61/904,364, filed Nov. 14, 2013, entitled FITMENT COUPLER WITH CAP, which is hereby incorporated in its entirety by reference herein.

BACKGROUND

1. Field

The present invention relates generally to containers operable to store and dispense food stuffs such as icing, glaze, frosting, filling, and the like. More specifically, embodiments of the present invention concern a fitment assembly to support a decorating nozzle on a container.

2. Discussion of Prior Art

Various types of known devices have been used to dispense icing, frosting, fillings, and other spreadable food stuffs. Food stuffs such as icing are commonly dispensed onto cakes, pies, cookies, and other dessert confectionaries, for instance, as an edible decoration. Prior art confectionary dispensing devices include flexible icing pouches having a pouch, a pouch fitment, and a nozzle. In the usual manner, the pouch contains the spreadable confectionary or other food stuff to be dispensed. The fitment is used to removably secure the nozzle to the pouch, with the food stuff being dispensed through the fitment and nozzle in a controlled manner.

However, prior art icing pouches and other confectionary dispensing devices have been found to exhibit various deficiencies. For instance, prior art reusable icing pouches require a chef or other user to spend a significant amount of time preparing the spreadable confectionary and loading the confectionary into the pouch. Any unused portions of confectionary in the pouch must then be removed from the pouch. Prior to further use, the pouch must then be cleaned using conventional washing techniques. This time consuming process of loading and unloading/cleaning of the pouch is especially problematic if the same pouch is used to apply multiple types and/or colors of confectionary in quick succession (e.g., when different confectionaries are applied to the same cake). Generally, conventional icing pouches are not suitable for long term storage of confectionary prior to use.

Similarly, prior art reusable pouch fitments and nozzles require the user to remove unused portions of confectionary from the fitment and nozzle. The fitment and nozzle must be cleaned using conventional washing techniques for later use. Similar to the use of conventional pouches, the cleaning process is problematic if the same fitment or nozzle is used to apply multiple types and/or colors of confectionary in quick succession.

SUMMARY

The following brief summary is provided to indicate the nature of the subject matter disclosed herein. While certain aspects of the present invention are described below, the summary is not intended to limit the scope of the present invention.

Embodiments of the present invention provide a handheld confectionary dispenser that does not suffer from the problems and limitations of the prior art dispensers set forth above.

A first aspect of the present invention concerns a fitment assembly operable to dispense confectionary from a container and to operably support a decorating nozzle through which the dispensed confectionary is discharged. The fitment assembly broadly includes a fitment body and a coupler. The fitment body is operable to be attached relative to the container and presents a continuous fitment passage leading to a downstream fitment opening. The coupler includes a coupler ring and a removable coupler cap. The coupler ring presents a ring opening, with the coupler ring mounted so that the fitment body extends into the ring opening. The coupler cap spans the ring opening so as to cover the fitment opening. The coupler cap is removably attached to the coupler ring along a line of weakness, with the coupler cap being separable from the coupler ring along the line of weakness to expose the fitment opening.

A second aspect of the present invention concerns a confectionary dispenser operable to dispense confectionary through a decorating nozzle. The confectionary dispenser broadly includes a hollow flexible pouch and a fitment assembly. The pouch defines a pouch chamber to contain the confectionary. The fitment assembly is operable to dispense the confectionary from the pouch and to operably support the decorating nozzle through which the dispensed confectionary is discharged. The fitment assembly broadly includes a fitment body and a coupler. The fitment body communicates with the pouch chamber and presents a continuous fitment passage leading to a downstream fitment opening. The coupler includes a coupler ring and a removable coupler cap. The coupler ring presents a ring opening, with the coupler ring mounted so that the fitment body extends into the ring opening. The coupler cap spans the ring opening so as to cover the fitment opening. The coupler cap is removably attached to the coupler ring along a line of weakness, with the coupler cap being separable from the coupler ring along the line of weakness to expose the fitment opening.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
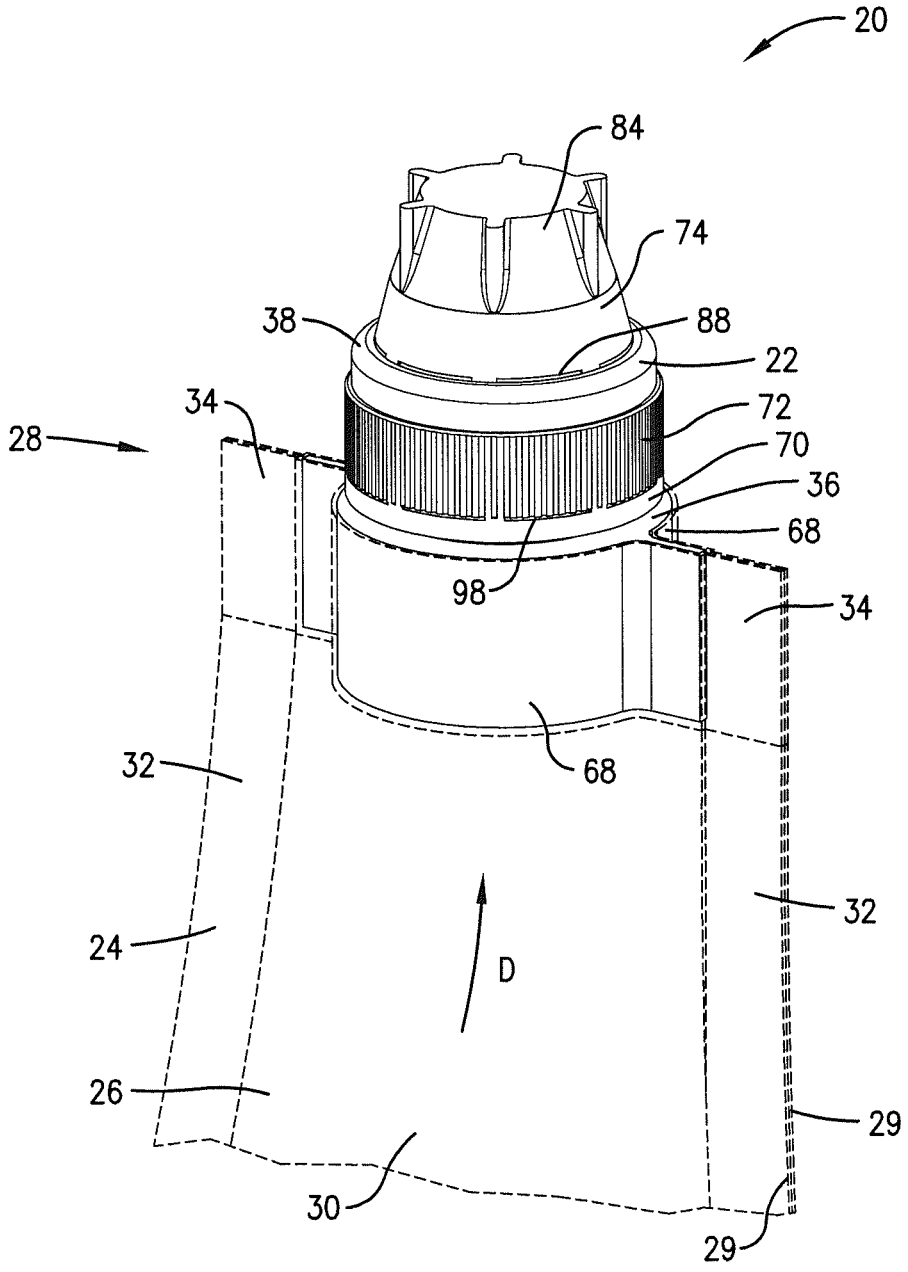
FIG. 1 is a fragmentary perspective of a handheld confectionary dispenser constructed in accordance with a preferred embodiment of the present invention, with the dispenser including a fitment assembly and a pouch, and showing a fitment and a coupler of the fitment assembly.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a handheld confectionary dispenser 20 is constructed in accordance with a preferred embodiment of the present invention. In the usual manner, the dispenser 20 is preferably used to contain icing and selectively distribute the icing on confections and other food stuffs. However, it is within the ambit of the present invention where the dispenser 20 is used to dispense various food stuffs, such as frostings, glazes, fillings, creams, toppings, and other spreadable confectionary substances. The term confectionary as used herein shall be interpreted to include icing, frosting, glaze, filling, cream, toppings, and other similar substances used in the food industry, particularly those that are manually dispensed. The present invention is especially useful in manually dispensing creamy confectionary substances for food decorating purposes.

The dispenser 20 is preferably configured to be prefilled with confectionary (not shown) and sealed to provide a sealed prefilled dispenser. However, it is within the scope of the present invention where dispenser 20 is filled without being later sealed. It is also within the ambit of the present invention for the dispenser 20 to be distributed unfilled, such that the user fills the dispenser with confectionary as needed. If desired, the dispenser may also be reused. The dispenser 20 broadly includes a fitment assembly 22 and a hollow flexible pouch 24.

In the usual manner, the dispenser 20 is configured to support a decorating nozzle N (see FIG. 4) and to discharge confectionary through the decorating nozzle N. The elongated nozzle N presents upstream and downstream nozzle ends and a nozzle passage P that extends continuously between the ends. The upstream nozzle end preferably presents a larger diameter dimension than the downstream nozzle end, with the nozzle N tapering away from the upstream nozzle end. However, it will be appreciated that the nozzle N could be alternatively configured.

The flexible pouch 24 preferably has an elongated hollow shape and presents an outer surface 26 that extends between an upstream reservoir end (not shown) and a downstream dispensing end 28. The illustrated pouch 24 also includes opposite pouch sections 29 that define an interior chamber 30 extending between the reservoir end and dispensing end 28 to receive and contain confectionary. The illustrated pouch sections 29 are preferably sealed along sealed side margins 32 that extend longitudinally between the pouch ends. Along the dispensing end 28, the pouch sections 29 are also preferably sealed along end margins 34 that are sealed to the fitment assembly 22. It is also within the scope of the present invention where the pouch 24 is alternatively sealed and/or attached to the fitment assembly 22.

Furthermore, the dispenser 20 could also include a structure that interconnects the fitment assembly 22 and pouch 24 to permit fluid communication therebetween. For instance, the dispenser 20 could include an elongated tubular structure (not shown) sealed at one end to the pouch 24 and at an opposite end to the fitment assembly 24.

The pouch 24 preferably includes a synthetic resin material. More preferably, each pouch section 29 includes a polymer material, such as polyethylene and/or polypropylene, but could include one or more alternative materials without departing from the scope of the present invention.

The flexible pouch 24 can preferably be folded, twisted, squeezed, or otherwise deformed to change the volume of the chamber 30. In this manner, deformation of the pouch 24 is preferably used to move confectionary through the chamber 30 and/or to urge confectionary out of the chamber 30. Preferably, confectionary is generally moved through the chamber 30 in a downstream direction D.

However, it is within the ambit of the present invention where the fitment assembly 22 is used with an alternative container to dispense confectionary. For instance, the fitment assembly 22 could be used with any of various flexible pouch shapes and/or configurations. Some examples of suitable flexible pouches that could be used in combination with the fitment assembly of the present invention are disclosed in U.S. Provisional Application No. 61/904,272, filed Nov. 14, 2013, entitled HANDHELD CONFECTIONARY DISPENSER, and U.S. Provisional Application No. 61/904,325, filed Nov. 14, 2013, entitled SINGLE SEAM HANDHELD CONFECTIONARY DISPENSER, each of which is hereby incorporated in its entirety by reference herein. Furthermore, the fitment assembly 22 could be used with a relatively rigid container.

Turning to FIGS. 1-5, the illustrated fitment assembly 22 preferably includes a fitment 36 and a coupler 38. In the usual manner, the fitment 36 and the coupler 38 are configured to cooperatively hold the decorating nozzle N as confectionary is discharged through the decorating nozzle N. The fitment assembly 22 is also preferably designed to permit selective opening of the pouch 24 and to selectively permit dispensing of confectionary from the pouch 24.

The fitment assembly 22 preferably includes a synthetic resin material. More preferably, the fitment assembly 22 includes a polyolefin material, although other thermoplastic materials could be used without departing from the scope of the present invention.

Figure 3:
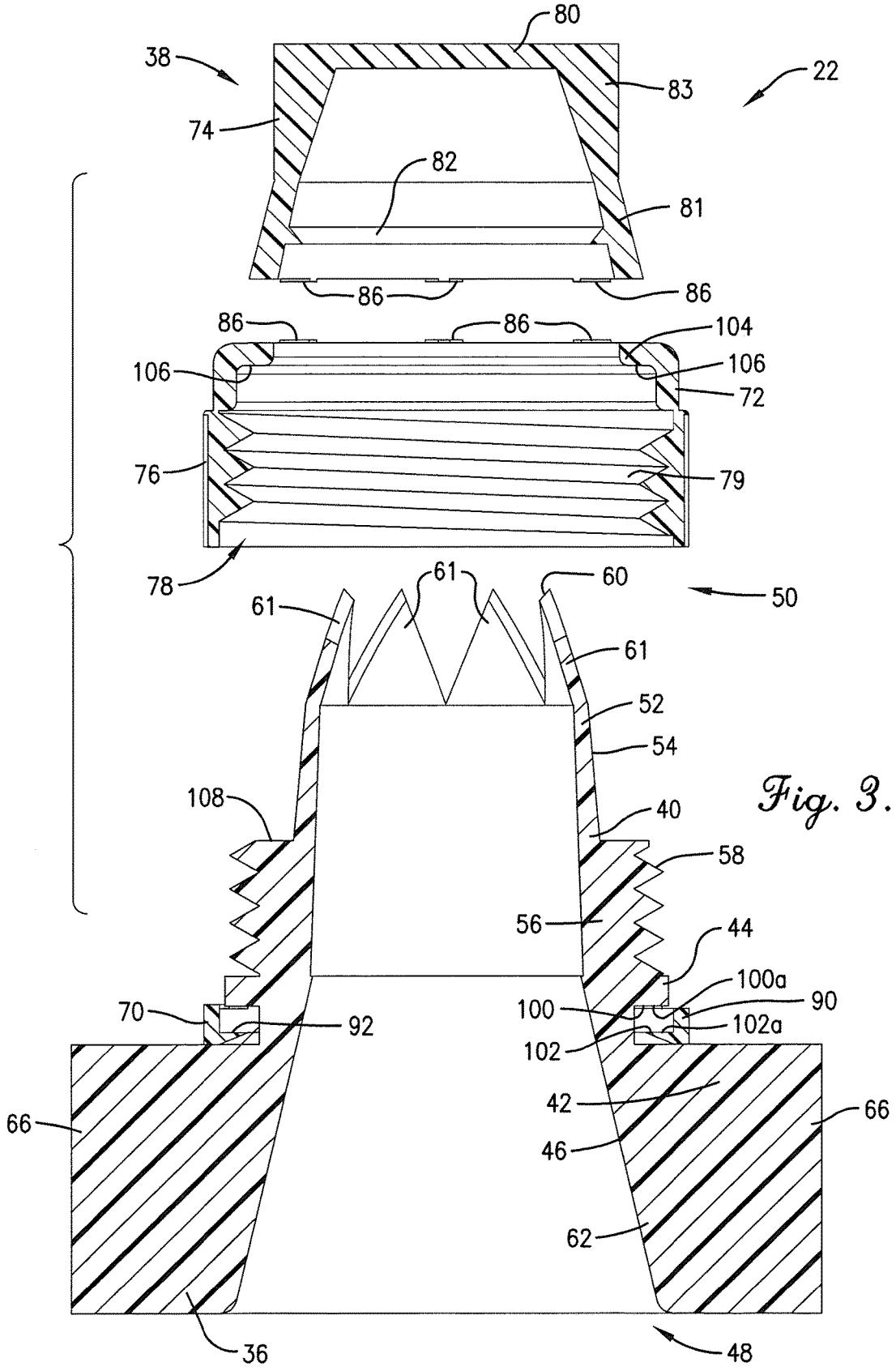
FIG. 3 is an exploded cross section of the fitment assembly shown in FIGS. 1 and 2, showing the coupler ring and the coupler cap removed from the fitment and separated from one another.
Figure 6:
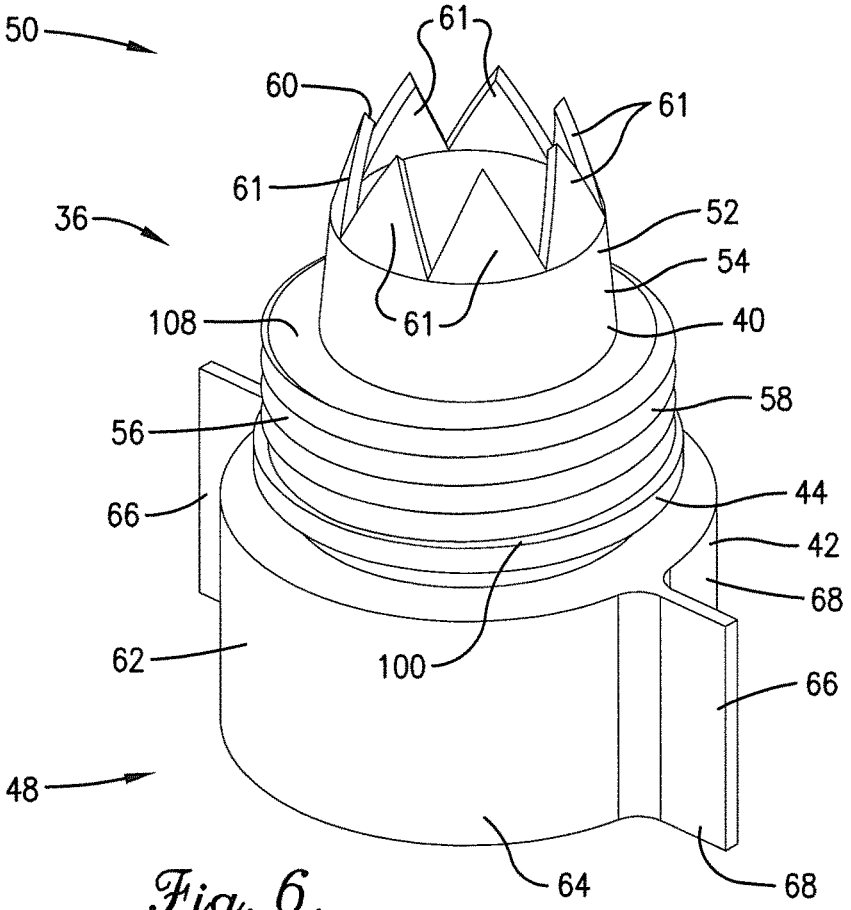
FIG. 6 is an upper perspective of the fitment shown in FIGS. 1-4.

Turning to FIGS. 3 and 6, the illustrated fitment 36 preferably includes a fitment nozzle body 40, a seal body 42, and a flange 44 that are integrally formed with one another. Also, the fitment 36 presents a continuous fitment passage 46 that tapers in the downstream direction D (see FIG. 3) and extends from an upstream fitment end 48 to a downstream fitment end 50.

The fitment nozzle body 40 is generally tubular and includes a downstream portion 52 that presents an outer surface 54 that tapers in the downstream direction D. The fitment nozzle body 40 also includes an upstream portion 56 that presents external threads 58 to provide a universal threaded connection. The flange 44 is located upstream of the threads 58 and projects radially outwardly from the upstream portion 56.

The fitment nozzle body 40 preferably presents a downstream fitment opening 60 that fluidly communicates with the fitment passage 46. The illustrated opening 60 is preferably formed by fingers 61 of the downstream portion 52.

However, the opening 60 could be alternatively shaped (e.g., where the downstream portion 52 is alternatively configured). The fitment assembly 22 preferably includes the coupler 38 so that the coupler can be used to close the opening 60. In this manner, the dispenser 20 can be prefilled with confectionary for subsequent sale, storage, and transportation. As will be discussed, the coupler 38 can be selectively removed when the user is ready to discharge confectionary from the dispenser 20 (e.g., by attaching the decorating nozzle N to the fitment 36).

The illustrated seal body 42 is attached to the upstream portion 56 of the fitment nozzle body 40. The illustrated seal body 42 preferably includes an elongated base 62 with a central tubular section 64 and a pair of flanges 66 (see FIG. 6). The tubular section 64 and flanges 66 cooperatively present opposite sealing surfaces 68. While the illustrated seal body 42 is preferred, the principles of the present invention are applicable where the seal body 42 is alternatively configured. For instance, the seal body 42 could be alternatively constructed for sealing attachment to the pouch 24.

The end margins 34 of pouch sections 29 are preferably sealed to respective sealing surfaces 68 of the fitment assembly 22. Again, it is within the scope of the present invention where the pouch 24 is alternatively sealed and/or attached to the fitment assembly 22. However, for some aspects of the present invention, the pouch 24 may not be attached directly to the fitment assembly 22. As discussed above, the dispenser 20 could also include a structure that interconnects the fitment assembly 22 and pouch 24 to permit fluid communication therebetween.

Turning to FIGS. 2-5, the coupler 38 preferably includes a security ring 70, a coupler ring 72 and a coupler cap 74. The illustrated coupler 38 is preferably integrally formed and is removably threaded onto the fitment 36. As will be discussed, the coupler cap 74 is preferably selectively removable from the coupler ring 72 so that the fitment opening 60 is exposed. Furthermore, selective removal of the coupler ring 72 preferably permits the decorating nozzle N to be mounted on the fitment 36 and held in place by the coupler ring 72.

The illustrated coupler ring 72 preferably includes an endless annular wall that presents a knurled outer surface 76 and a threaded opening 78 (see FIGS. 3-5) that receives the decorating nozzle N. Surrounding the threaded opening 78, the coupler ring 72 preferably presents internal threads 79 that are threadably engaged with the external threads 58 of the fitment 36. Thus, the coupler ring 72 is preferably threaded onto the threaded connection of the fitment 36. In this manner, the coupler ring 72 is operable to engage and hold a flared proximal end of the decorating nozzle N against the fitment 36. However, for some aspects of the present invention, the coupler 38 and fitment 36 could have an alternative attachment structure for selectively permitting attachment and detachment relative to one another. For instance, it is not necessary that external threads be located on the fitment 36 and internal threads on the coupler 38. Rather, the internal threads could be part of the fitment 36 (e.g., inside the nozzle body 40), and the external threads could be part of the coupler 38 (e.g., where the coupler 38 includes a threaded projection that extends into the nozzle body 40).

Referring again to FIGS. 2-5, the coupler cap 74 is preferably unitary and preferably includes a generally round plate 80 and an endless sidewall 81 that projects downwardly from the plate 80. The coupler cap 74 also preferably includes an endless annular seal 82 that is integral with the sidewall 81 (see FIGS. 2 and 3). The seal 82 preferably presents a generally triangular cross-sectional shape so that the seal 82 forms a wiper that tapers radially inwardly from the sidewall 81 to engage the downstream portion 52. However, the seal 82 could be alternatively shaped. Furthermore, the illustrated seal 82 could be removably mounted on the sidewall 81 and/or the downstream portion 52. For instance, the seal 82 could comprise a removable o-ring seal having a generally circular cross section (e.g., where the o-ring is removably mounted in an o-ring gland presented in the sidewall 81 and/or the downstream portion 52).

In the illustrated embodiment, the seal 82 is preferably positioned between the threads 58 of the nozzle body 40 and the fitment opening 60 of the nozzle body 40. The seal 82 is also preferably positioned between the threads 79 of the coupler ring 72 and the fitment opening 60 of the nozzle body 40. In this manner, the seal 82 is positioned to restrict confectionary from flowing out of the fitment opening 60 and through the threaded connection provided by the threads 58,79. However, the seal 82 could be alternatively positioned.

Yet further, the coupler cap 74 preferably includes a series of ribs 83 that are integrally formed with the sidewall 81 and project radially outwardly from the sidewall 81. The ribs 83 and the sidewall 81 cooperatively provide a gripping surface 84 (see FIG. 5) to facilitate manual separation of the coupler cap 74 from the coupler ring 72. However, the cap 74 could be alternatively configured (e.g., to provide an alternative gripping surface) without departing from the scope of the present invention.

The cap 74 is preferably located to span and cover the opening 78. Also, the cap 74 is preferably attached to an upper end of the coupler ring 72 by a relatively thin interconnecting wall 85 with circumferentially spaced supports 86 (see FIG. 5). Thus, the illustrated wall 85 preferably provides a line of weakness 88 between the coupler ring 72 and coupler cap 74. The coupler cap 74 is selectively separable from the coupler ring 72. For instance, while the coupler 38 is secured to the fitment 36, the user can grasp the gripping surface 84 to pry the coupler cap 74 away from the coupler ring 72. With the application of force to the gripping surface 84, the user can sever the supports 86 to separate the coupler cap 74 from the coupler ring 72. However, the supports 86 could be alternatively severed by the user (e.g., where the user cuts the supports 86 with a knife).

The illustrated coupler 38 is preferably configured to be threaded onto and off of the fitment 36. Furthermore, the coupler 38 is operable to be threaded into and out of a closing or secured position (see FIGS. 1 and 2) where the coupler cap 74 contacts or is positioned adjacent to the downstream end 50 of the fitment 36 to cover the fitment opening 60.

The illustrated wall 85 is preferably configured to permit selective separation of the coupler cap 74 from the coupler ring 72 along the line of weakness 88. Consequently, complete separation of the coupler cap 74 from the coupler ring 72 enables the fitment opening 60 to be exposed and permits the decorating nozzle N to be mounted on the fitment 36 and held in place by the coupler ring 72.

However, the coupler ring 72 and coupler cap 74 could be connected to one another by an alternatively configured line of weakness to permit separation of the coupler ring 72 and coupler cap 74. For instance, the wall 85 could be alternatively constructed to provide a different line of weakness that still allows the coupler cap 74 to be entirely separated from the coupler ring 72 (e.g., where the wall 85 comprises an endless annular wall having a reduced thickness compared to the wall thickness of the coupler ring 72 and coupler cap 74).

Figure 2:
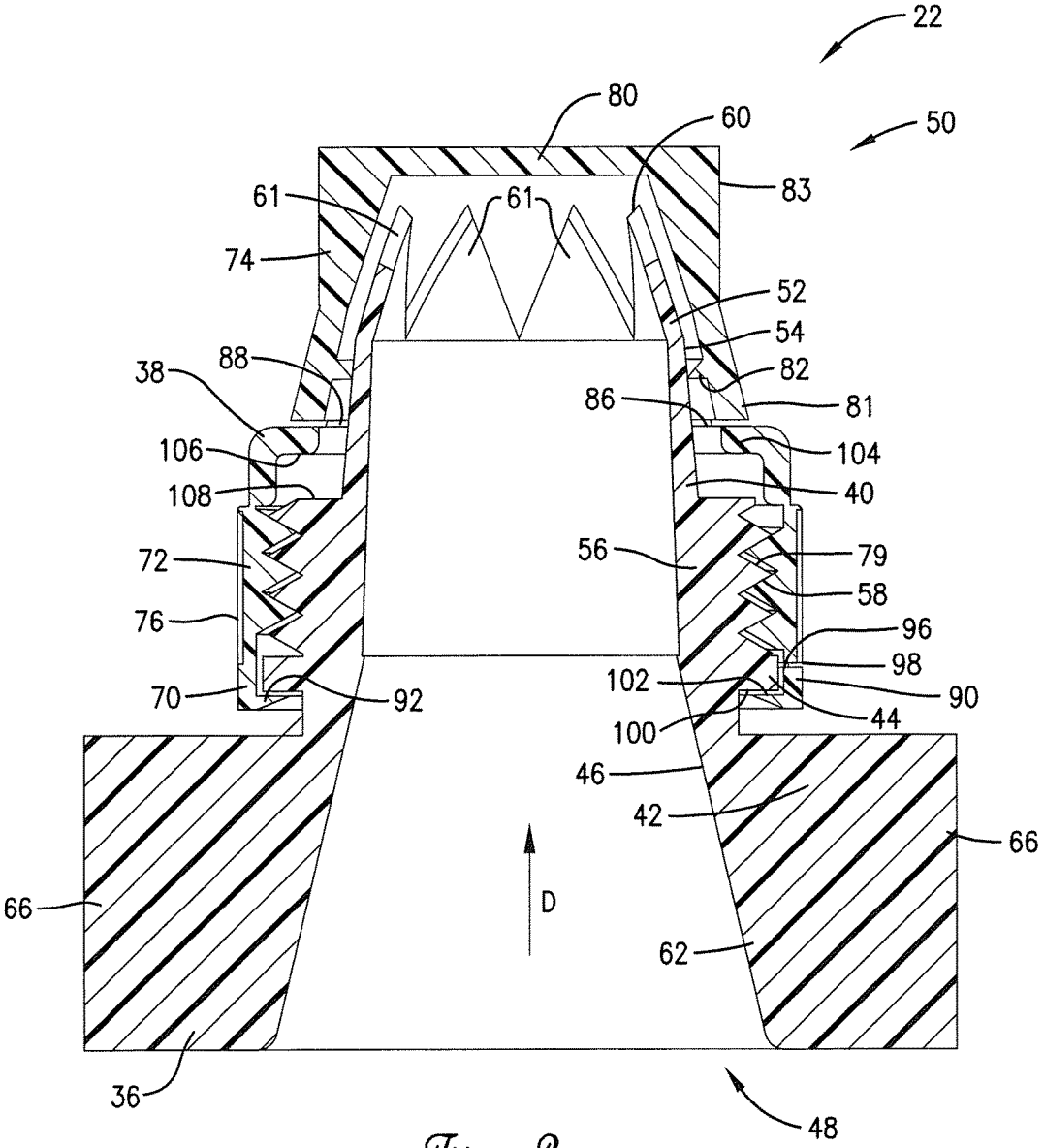
FIG. 2 is a cross section of the fitment assembly shown in FIG. 1, showing a fitment nozzle body, a seal body, and a flange of the fitment, and further showing a coupler cap, coupler ring, and security ring of the coupler secured to the fitment, with a downstream fitment opening of the fitment being covered and sealed by the coupler in a secured position.
Figure 4:
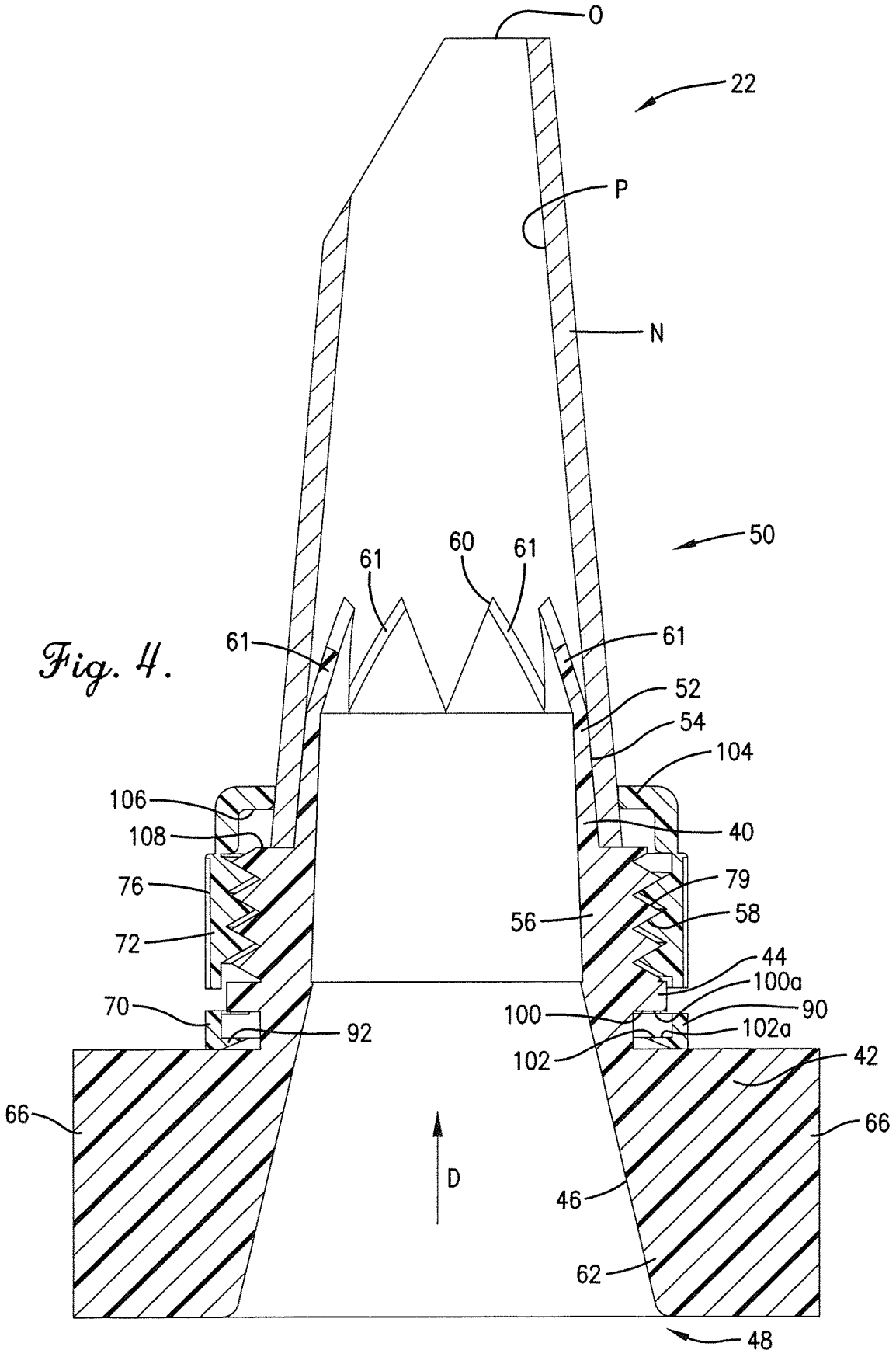
FIG. 4 is a fragmentary cross section of the fitment assembly shown in FIGS. 1-3, showing a decorating nozzle frictionally secured to the fitment by the coupler ring.

Turning to FIGS. 2-4, the security ring 70 is operable to indicate when the coupler ring 72 has been removed from the fitment 36 (thereby providing a tamper evident feature). The security ring 70 also cooperates with the fitment 36 to restrict against removal of the coupler ring 72, as will be described. The illustrated security ring 70 preferably includes an endless annular wall 90 and an annular lip 92 that projects radially inwardly from the wall 90. The security ring 70 can be moved into engagement with the fitment 36. More particularly, the security ring 70 can be moved in an upstream direction to a location upstream of the flange 44. In this location, a locking shoulder of the flange 44 can engage a locking shoulder of the annular lip 92 to restrict removal of the security ring 70 from the fitment 36.

Figure 5:
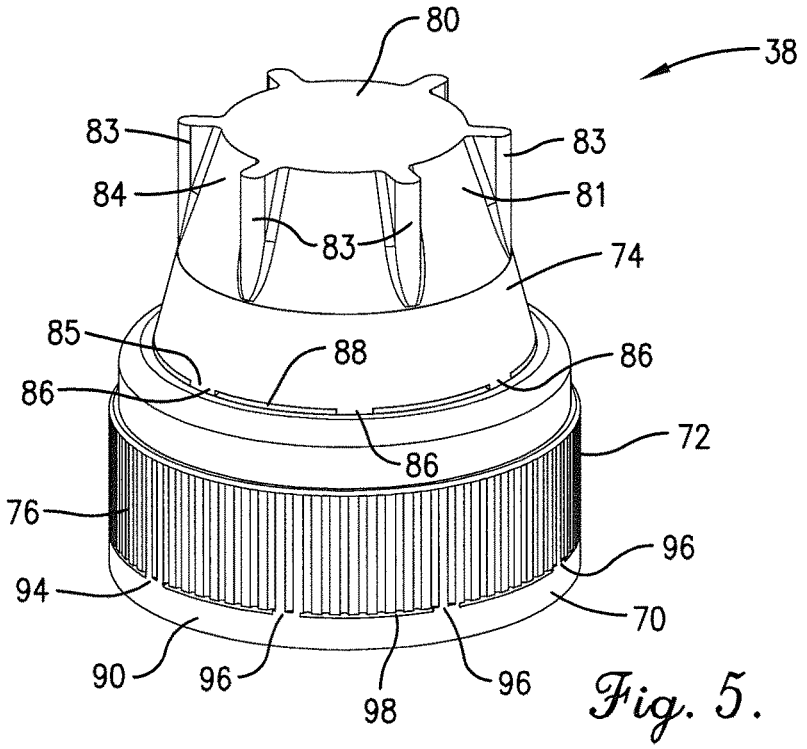
FIG. 5 is an upper perspective of the coupler shown in FIGS. 1-4.

The security ring 70 is preferably attached to a lower end of the coupler ring 72 by a relatively thin interconnecting wall 94 with circumferentially spaced supports 96 (see FIG. 5). Thus, the illustrated wall 94 preferably provides a line of weakness 98 between the coupler ring 72 and security ring 70 (see FIGS. 2 and 5).

It will be appreciated that the security ring 70 and the coupler ring 72 could be connected to one another by an alternatively configured line of weakness to permit separation. For instance, the wall 94 could be alternatively constructed to provide a different line of weakness that still allows the security ring 70 to be entirely separated from the coupler ring 72 (e.g., where the wall 94 comprises an endless annular wall having a reduced thickness compared to the wall thickness of the coupler ring 72 and the security ring 70).

The wall 94 is preferably configured to permit selective separation of the security ring 70 from the coupler ring 72 along the line of weakness 98. To separate the coupler ring 72 from the security ring 70, the coupler ring 72 is threadably unscrewed from the nozzle body 40 while the flange 44 retains the security ring 70 on the fitment 36. In turn, removal of the coupler ring 72 allows the decorating nozzle N to be mounted on the fitment 36 and then secured in place by the coupler ring 72.

The coupler 38 is preferably secured to the fitment 36 in a unitary form by threading the coupler ring 72 onto the fitment 36 in an upstream direction toward the seal body 42. In particular, the coupler ring 72 is threaded onto the threads 58 of the fitment 36 until the annular lip 92 of the security ring 70 is advanced beyond the flange 44. Once the annular lip 92 is positioned upstream of the flange 44, a locking shoulder 100 of the flange 44 is operable to engage a locking shoulder 102 of the annular lip 92 to restrict removal of the coupler 38 from the fitment 36. That is, the shoulders 100,102 cooperatively restrict movement of the coupler ring 72 relative to the fitment 36 from the secured position (see FIG. 2). In the illustrated embodiment, the shoulders 100, 102 present faces 100*a*,102*a* that project radially and oppose one another (see FIGS. 3 and 4). The faces 100*a*,102*a* engage one another when the coupler ring 72 is rotated relative to the fitment 36 (i.e., on the threads 58 of the fitment 36) from the secured position.

While the security ring 70 preferably includes the locking shoulder 102, the coupler 38 could be alternatively configured. For instance, the coupler 38 could be devoid of the locking shoulder 102 (e.g., where the coupler 38 does not include the security ring 70).

As the coupler 38 is mounted on the fitment 36 in the secured position (by screwing the ring 72 onto the nozzle body 40), the endless annular seal 82 preferably projects radially inwardly from the sidewall 81 to sealingly engage the fitment nozzle body 40 and thereby seal closed the fitment assembly 22 (see FIG. 2). In the illustrated embodiment, when the coupler 38 is secured to the fitment 36, the seal 82 is preferably positioned between the threads 79 of the coupler ring 72 and the fitment opening 60 of the nozzle body 40. Again, the seal 82 is preferably positioned to restrict confectionary from flowing out of the fitment opening 60 and through the threaded connection provided by the threads 58,79. However, the coupler 38 could be alternatively configured to seal closed the fitment assembly 22.

Thus, security ring 70 cooperates with the flange 44 of the fitment 36 to initially prevent inadvertent removal of the coupler 38 from the fitment 36. However, once it is desired to dispense product from the pouch 24, the coupler 38 is rotated relative to the fitment 36 which shifts the security ring 70 axially into engagement with the flange 44 (along the faces 100*a*,102*a*). Eventually, continued relative rotation of the coupler 38 will cause separation of the security ring 70 from the coupler ring 72, providing evidence that the fitment assembly 22 has been opened.

When the user is ready to dispense confectionary from the dispenser 20, the gripping surface 84 facilitates manual separation of the coupler cap 74 from the coupler ring 72. The coupler cap 74 is preferably separated from the coupler ring 72 while the coupler ring 72 is secured to the fitment 36. This separation exposes the fitment opening 60.

Once the coupler cap 74 is separated from the coupler ring 72 the coupler ring 72 is removed from the fitment 36 by unscrewing the coupler ring 72 from the nozzle body 40. Again, as the coupler ring 72 is removed, the flange 44 retains the security ring 70 on the fitment 36.

It will be appreciated that the coupler cap 74 and coupler ring 72 could be alternatively removed from the fitment 36 and separated from one another. For instance, the coupler cap 74 and coupler ring 72 could be separated from each other after the coupler ring 72 is removed from the fitment 36. That is, the coupler ring 72 and coupler cap 74 could be removed from the fitment 36 as a unitary structure and then separated from one another.

The desired decorating nozzle N is selectively attached to the pouch 24 with the coupler ring 72. The nozzle N is positioned so that the nozzle passage P receives the fitment 36 and is removably positioned on the fitment 36 (see FIG. 4). A discharge opening O of the decorating nozzle N communicates with the nozzle passage P and the fitment passage 46 when the decorating nozzle N is mounted on the fitment 36. It will be appreciated that various decorating nozzles could be selectively mounted on the fitment 36. In the usual manner, the fitment 36 can be used with decorating nozzles having differently sized and shaped discharge openings (e.g., to create different sizes and/or shapes of confectionary).

With the nozzle N mounted on the fitment 36, the nozzle N can be secured by sliding the coupler ring 72 onto the nozzle N and threading the coupler ring 72 onto the threads 58 of the nozzle body 40 (see FIG. 4). The coupler ring 72 preferably includes a flange 104 that projects radially inwardly to frictionally engage the nozzle N when the coupler ring 72 is secured onto the nozzle body 40 (see FIGS. 2-4). In the illustrated embodiment, this frictional engagement is provided because the nozzle N tapers away from the upstream nozzle end and the upstream nozzle end has a diameter dimension that is larger than the opening presented by the flange 104. However, it is within the scope of the present invention where the coupler ring 72 alternatively secures a decorating nozzle. For instance, where the decorating nozzle has a radially outwardly extending nozzle flange at the upstream nozzle end, the nozzle flange could be mechanically secured between a shoulder 106 of the flange 104 and a shoulder 108 of the nozzle body 40.

Similarly, the nozzle N can be selectively removed from the fitment 36 by threading the coupler ring 72 out of engagement with the threads 58 of the nozzle body 40. The nozzle N and coupler ring 72 are removed from the nozzle body 40 at the same time by moving the nozzle body 40 out of the nozzle passage P. Alternatively, it will be appreciated that the coupler ring 72 could first be removed from the nozzle body 40 and then the nozzle N could be subsequently removed from the nozzle body 40.

In use, the coupler 38 is preferably mounted in the secured position (see FIGS. 1 and 2) prior to filling the dispenser 20 with confectionary (confectionary is preferably added to the pouch 24 via the reservoir end (not shown) and the reservoir end is then subsequently sealed. However, it is within the scope of the present invention where the dispenser 20 is alternatively filled (e.g., where confectionary is introduced to the pouch 24 via the fitment 36).

When the user is ready to dispense confectionary from the dispenser 20, the coupler cap 74 is separated from the coupler ring 72. With the coupler cap 74 removed, the coupler ring 72 can be threaded off of the fitment 36 so that the decorating nozzle N can be inserted into the opening 78. This permits the decorating nozzle to be mounted onto the fitment 36 while also threading the coupler ring 72 onto the fitment 36.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A fitment assembly operable to dispense confectionary from a container and to operably support a decorating nozzle through which the dispensed confectionary is discharged, said fitment assembly comprising:

a fitment body operable to be attached relative to the container and presenting a continuous fitment passage leading to a downstream fitment opening; and a coupler including a coupler ring and a removable coupler cap, said coupler ring presenting a ring opening, with the coupler ring mounted so that the fitment body extends into the ring opening, said coupler cap spanning the ring opening so as to cover the fitment opening, said coupler cap being removably attached to the coupler ring along a line of weakness, with the coupler cap being separable from the coupler ring along the line of weakness to expose the fitment opening, said coupler ring being threadably coupled to the fitment body, with the coupler ring being rotated relative to the fitment body into a secured position, said coupler cap including an endless annular seal projecting radially inwardly from the sidewall to sealingly engage the fitment body, said coupler ring presenting threads for threadably coupling to the fitment body, said seal being located between the threads and the fitment opening.

2. The fitment assembly as claimed in claim 1, said fitment body projecting through the ring opening and defining a downstream fitment end that presents the fitment opening, said coupler cap being positioned adjacent to the downstream fitment end to cover the fitment opening.

3. The fitment assembly as claimed in claim 2, said coupler cap including a circumferentially extending endless sidewall attached to the coupler ring along the line of weakness and surrounding the fitment opening prior to being removed.

4. The fitment assembly as claimed in claim 3, said coupler cap including exterior ribs integrally formed with and projecting radially outwardly from the sidewall, said ribs and said sidewall cooperatively providing a gripping surface to facilitate manual separation of the coupler cap from the coupler ring.

5. The fitment assembly as claimed in claim 1, said coupler and fitment body presenting cooperating locking shoulders configured to cooperatively restrict movement of the coupler ring relative to the fitment body from the secured position.

6. The fitment assembly as claimed in claim 5, said shoulders presenting opposed faces that project generally radially, said faces being configured to engage one another when the coupler ring is rotated relative to the fitment body from the secured position.

7. The fitment assembly as claimed in claim 6, said coupler further including a security ring that presents a corresponding one of the shoulders, said security ring being removably attached to the coupler ring along another line of weakness, with the security ring being entirely separable from the coupler ring along the another line of weakness as the coupler ring is rotated relative to the fitment body from the secured position.

8. The fitment assembly as claimed in claim 1, said fitment body including a nozzle body that presents the downstream fitment opening and a seal body that presents an upstream fitment opening, with the fitment passage extending from the upstream fitment opening to the downstream fitment opening, said nozzle body including threads that threadably receive the coupler ring.

9. The fitment assembly as claimed in claim 8, said nozzle body including a tapered downstream portion that extends downstream from the threads and presents an outer surface that tapers toward the downstream fitment opening.

10. The fitment assembly as claimed in claim 9,
said tapered downstream portion projecting downstream of the coupler ring.

11. The fitment assembly as claimed in claim 1,
said fitment body including a nozzle body that presents the downstream fitment opening and a seal body that presents an upstream fitment opening, with the fitment passage extending from the upstream fitment opening to the downstream fitment opening,
said seal body presenting opposite sealing surfaces located on opposite sides of the upstream fitment opening and configured to be in sealing engagement with the container.

12. The fitment assembly as claimed in claim 11,
said seal body including a tubular section that forms part of the fitment passage,
said seal body further including a flange attached to and projecting laterally outboard from the tubular section, with the tubular section and flange cooperatively presenting at least part of the opposite sealing surfaces.

13. The fitment assembly as claimed in claim 12,
said seal body including another flange attached to the tubular section and projecting laterally outboard from the tubular section,
said flanges extending in opposite directions from the tubular section, with the tubular section and flanges cooperatively presenting the opposite sealing surfaces.

14. A confectionary dispenser operable to dispense confectionary through a decorating nozzle, said confectionary dispenser comprising:
a hollow flexible pouch defining a pouch chamber to contain the confectionary; and
a fitment assembly operable to dispense the confectionary from the pouch and to operably support the decorating nozzle through which the dispensed confectionary is discharged, said fitment assembly including—
a fitment body communicating with the pouch chamber and presenting a continuous fitment passage leading to a downstream fitment opening, and
a coupler including a coupler ring and a removable coupler cap,
said coupler ring presenting a ring opening, with the coupler ring mounted so that the fitment body extends into the ring opening,
said coupler cap spanning the ring opening so as to cover the fitment opening,
said coupler cap being removably attached to the coupler ring along a line of weakness, with the coupler cap being separable from the coupler ring along the line of weakness to expose the fitment opening, said coupler ring being threadably coupled to the fitment body, with the coupler ring being rotated relative to the fitment body into a secured position, said coupler cap including an endless annular seal projecting radially inwardly from the sidewall to sealingly engage the fitment body, said coupler ring presenting threads for threadably coupling to the fitment body, said seal being located between the threads and the fitment opening.

15. The confectionary dispenser as claimed in claim 14,
said fitment body projecting through the ring opening and defining a downstream fitment end that presents the fitment opening,
said coupler cap being positioned adjacent to the downstream fitment end to cover the fitment opening.

16. The confectionary dispenser as claimed in claim 15,
said coupler cap including a circumferentially extending endless sidewall attached to the coupler ring along the line of weakness and surrounding the fitment opening prior to being removed.

17. The confectionary dispenser as claimed in claim 16,
said coupler cap including exterior ribs integrally formed with and projecting radially outwardly from the sidewall,
said ribs and said sidewall cooperatively providing a gripping surface to facilitate manual separation of the coupler cap from the coupler ring.

18. The confectionary dispenser as claimed in claim 14,
said coupler and fitment body presenting cooperating locking shoulders configured to cooperatively restrict movement of the coupler ring relative to the fitment body from the secured position.

19. The confectionary dispenser as claimed in claim 18,
said shoulders presenting opposed faces that project generally radially,
said faces being configured to engage one another when the coupler ring is rotated relative to the fitment body from the secured position.

20. The confectionary dispenser as claimed in claim 19,
said coupler further including a security ring that presents a corresponding one of the shoulders,
said security ring being removably attached to the coupler ring along another line of weakness, with the security ring being entirely separable from the coupler ring along the another line of weakness as the coupler ring is rotated relative to the fitment body from the secured position.

21. The confectionary dispenser as claimed in claim 14,
said fitment body including a nozzle body that presents the downstream fitment opening and a seal body that presents an upstream fitment opening, with the fitment passage extending from the upstream fitment opening to the downstream fitment opening,
said nozzle body including threads that threadably receive the coupler ring.

22. The confectionary dispenser as claimed in claim 21,
said nozzle body including a tapered downstream portion that extends downstream from the threads and presents an outer surface that tapers toward the downstream fitment opening.

23. The confectionary dispenser as claimed in claim 22,
said tapered downstream portion projecting downstream of the coupler ring.

24. The confectionary dispenser as claimed in claim 14,
said fitment body including a nozzle body that presents the downstream fitment opening and a seal body that presents an upstream fitment opening, with the fitment passage extending from the upstream fitment opening to the downstream fitment opening,
said seal body presenting opposite sealing surfaces located on opposite sides of the upstream fitment opening and configured to be in sealing engagement with the container.

25. The confectionary dispenser as claimed in claim 24,
said seal body including a tubular section that forms part of the fitment passage,
said seal body further including a flange attached to and projecting laterally outboard from the tubular section, with the tubular section and flange cooperatively presenting at least part of the opposite sealing surfaces.

26. The confectionary dispenser as claimed in claim 25, said seal body including another flange attached to the tubular section and projecting laterally outboard from the tubular section, said flanges extending in opposite directions from the tubular section, with the tubular section and flanges cooperatively presenting the opposite sealing surfaces.

* * * * *